United States Patent [19]

del Valle

[11] Patent Number: 4,761,126

[45] Date of Patent: Aug. 2, 1988

[54] TRAVELING CONCRETE CASTING MOLD

[76] Inventor: Jaime del Valle, 166 President Ramirez, Apt. 4, Hato Rey, P.R. 00919

[21] Appl. No.: 6,243

[22] Filed: Jan. 20, 1987

[51] Int. Cl.[4] ..... E04G 11/34

[52] U.S. Cl. ..... 425/62; 249/22; 249/36; 264/33; 425/63

[58] Field of Search ..... 425/62–64; 249/21, 22, 27, 36, 40, 189, 33; 264/33, 34

[56] References Cited

U.S. PATENT DOCUMENTS

| | | | |
|---|---|---|---|
| 3,482,005 | 12/1969 | Quentin | 264/34 |
| 3,790,321 | 2/1974 | Bunger | 425/63 |
| 4,150,808 | 4/1979 | Sawyer | 249/189 |

FOREIGN PATENT DOCUMENTS

| | | | |
|---|---|---|---|
| 539243 | 2/1956 | Italy | 425/63 |
| 103182 | 11/1963 | Norway | 425/63 |

*Primary Examiner*—Jay H. Woo
*Assistant Examiner*—James C. Housel
*Attorney, Agent, or Firm*—Berman, Aisenberg & Platt

[57] ABSTRACT

A traveling mold for forming a pre-cast, box-like concrete structure has movable frame means for supporting the mold. Inner and outer wall forms of the traveling mold are movable, vertically and transversely, away from a formed reinforced concrete wall section, after the wall section has hardened sufficiently to be self-supporting. A method for forming a pre-cast reinforced concrete building structure having a floor and at least one upstanding wall, using the traveling mold, is also described.

11 Claims, 5 Drawing Sheets

006243

FIG. 5
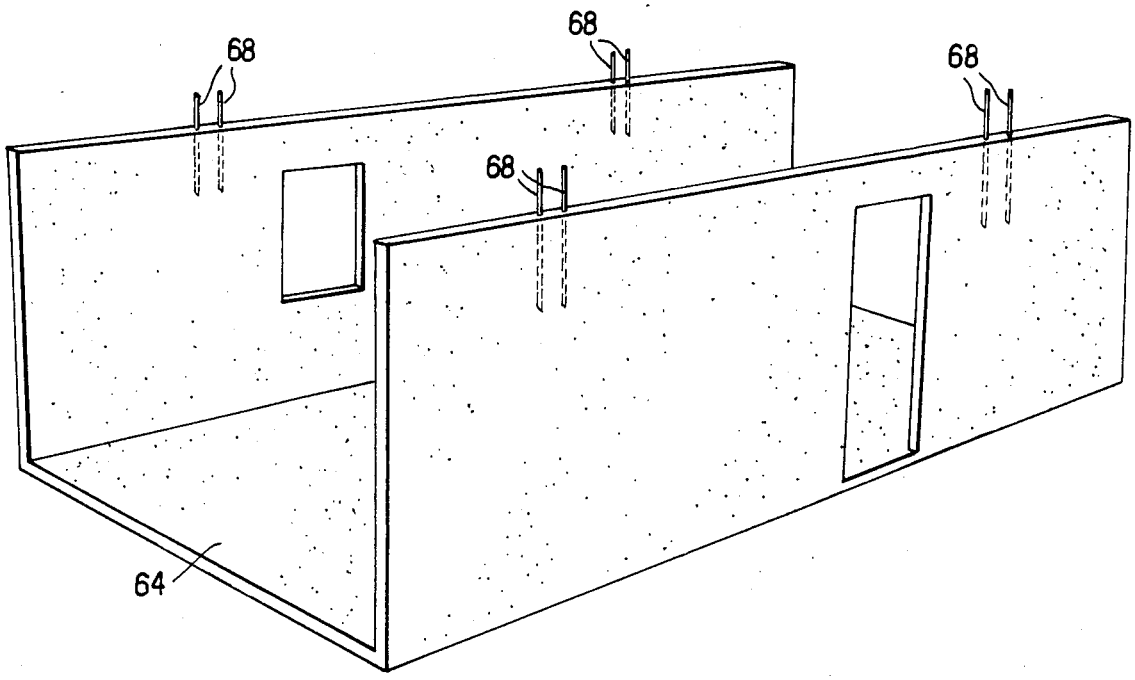
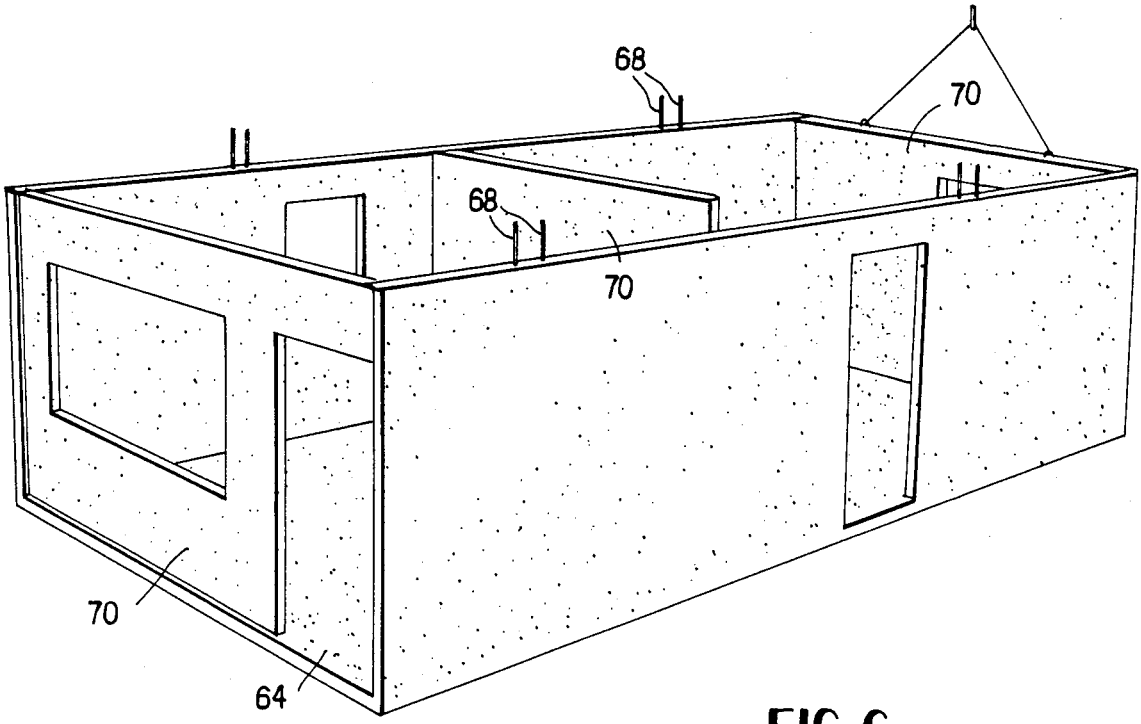
FIG. 6

FIG. 7
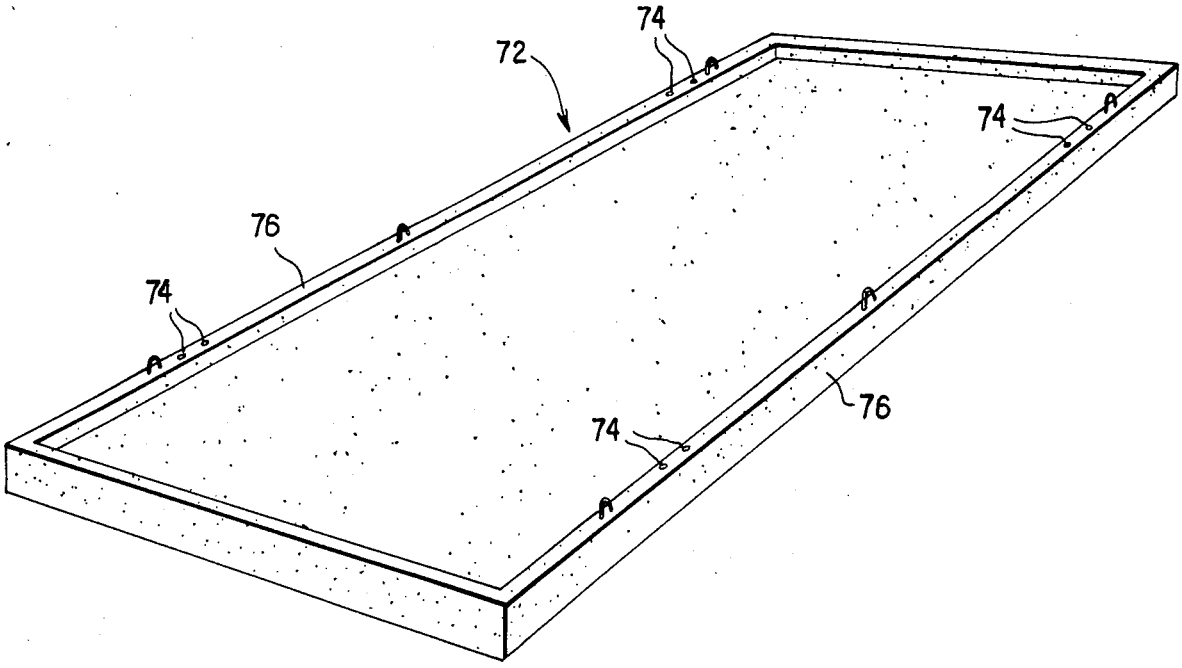
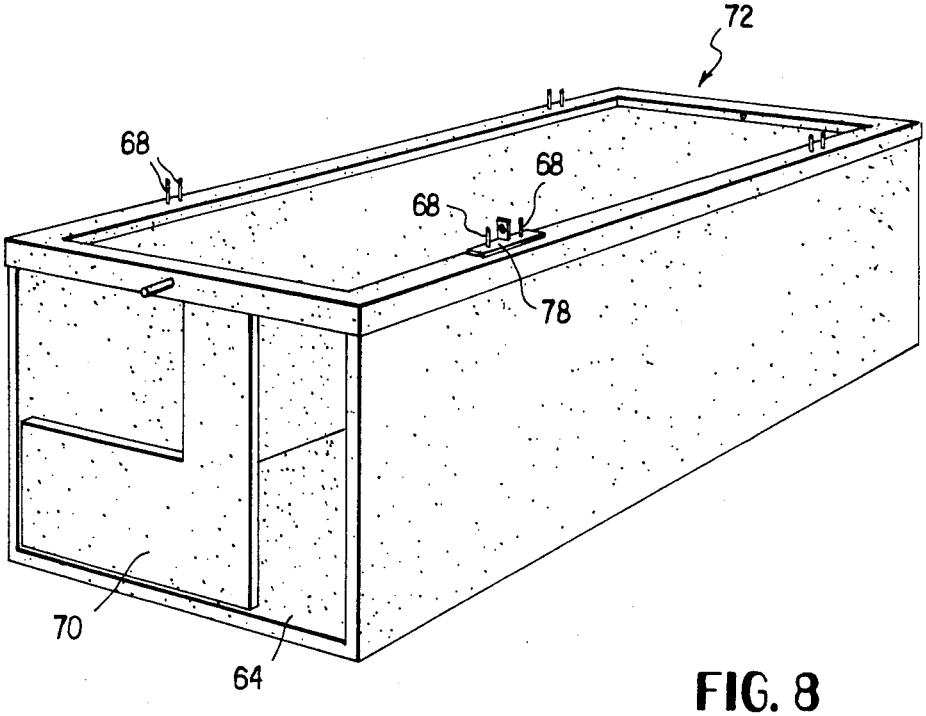
FIG. 8

TRAVELING CONCRETE CASTING MOLD

FIELD OF THE INVENTION

The invention relates to a method for pre-casting reinforced concrete structures generally used as prefabricated modules for housing, and a traveling mold for use therein.

BACKGROUND OF THE INVENTION

Pre-cast concrete modules are economical means of manufacturing prefabricated homes at low cost. Factory production also allows increased output and better quality control to be achieved.

The patent to Ferenc, U.S. Pat. No. 3,689,019 discloses a method and apparatus for forming inverted U-shaped reinforced concrete structures. There is no suggestion of moving the internal form or the external form to maximize production. Holland, U.S. Pat. No. 3,696,117 shows a method for forming a hollow tunnel-like structure out of concrete. The apparatus includes a unitary internal form that cannot be moved until the roof of the culvert is able to support itself. Holland does not suggest using such a form with a series of separate casting beds and moving the form from bed to bed. The patent to Verseluto, U.S. Pat. No. 3,834,110 describes a method of making rectangular concrete structures in which separate slabs are pre-cast and joined by additional poured concrete. Quintin, U.S. Pat. No. 3,482,005 and Bourdo, U.S. Pat. No. 3,963,395 each describes a similar process in which the casting frame is not moved from bed to bed.

Applicant's prior patents, U.S. Pat. Nos. 4,272,050, 4,372,906 and 4,495,131 concern a method of making pre-cast steel reinforced concrete box-like modules, and the modules produced, but are not concerned with a traveling form as described and claimed herein.

SUMMARY OF THE INVENTION

A reinforced concrete structure is cast in a traveling casting form located on a casting bed. When the cast walls of the module are firm enough to be self-supporting, the traveling mold is moved to the next casting bed for the next structure to be cast.

The traveling mold of the invention has inner wall forms and outer wall forms between which the concrete is poured over reinforcing mesh already in place. Inner wall forms and outer wall forms are movable both vertically and transversely, away from a cast reinforced concrete wall formed between them, after the wall has cured sufficiently to be self-supporting. The traveling mold, including the inner wall forms and outer wall forms, is movable longitudinally, preferably by rolling on wheels, from one casting bed to the next. A method of using the traveling mold is also described.

An object of the invention is to provide a traveling mold for forming a pre-cast concrete structure in which forms for supporting a reinforced concrete wall can be moved away from the partially cured wall for further use.

A further object of the invention is to provide an economical method for prefabricating reinforced concrete structures on an assembly line, using a traveling mold.

BRIEF DESCRIPTION OF THE DRAWINGS

FIG. 5 is a perspective view of a concrete casting after the traveling mold has been moved away.

FIG. 6 is a perspective view of a casting having concrete dividing walls fixed therein.

FIG. 7 is a perspective view of a separately cast roofing slab used with a pre-cast module of the invention.

FIG. 8 is a perspective view of a roof slab welded to a pre-cast module.

DETAILED DESCRIPTION OF THE INVENTION

The apparatus and method of the invention are advantageous in providing a movable wall assembly in which inner and outer wall-adjacent forms may each be individually moved both vertically and transversely, by means of trolley assemblies, to enable an open concrete structure having a floor and at least one wall upstanding from the floor to be formed on a casting bed, speedily and efficiently. The wall assemblies are moved away from the structure after the wall has cured sufficiently to be self-supporting, and the traveling mold is positioned on an adjacent casting bed for forming a further structure.

A series of adjacent casting beds may be used, and the traveling mold moved in progression from one bed to the next as a series of structures are formed. Preformed inner dividing walls and roofs may be added to each structure in subsequent operations, forming, in a preferred example, a concrete box-like module. Since the structure is cast before a roof is placed in position, a traveling wall form may be removed from a freshly cast wall after sufficient curing has taken place for the wall to be self-supporting, but before the wall is strong enough to support a roof, enabling maximum use of the traveling mold.

Inner and outer wall forms have faces of sheet steel or other suitable impervious material abutting the reinforced concrete wall formed therebetween, the face of each wall form being approximately the same height and length as each finished wall of the structure. The wall is generally a straight wall, approximately rectangular in shape, but the invention is equally applicable to curved wall forms for supporting a curved wall upstanding from a floor.

Either one pair of wall forms, providing means for forming a single wall upstanding from a floor, or two pairs of wall forms may be used. As a non-limiting example, a traveling mold having two pairs of wall forms used to make an open concrete box-like module is described. In this preferred embodiment, the reinforcing framework is a U-shaped reinforcing mesh cage, shown in FIG. 1, placed on a casting bed providing a reinforcing framework for a rectangular concrete floor and two spaced-apart walls upstanding from opposite parallel edges of the floor. The two pairs of wall forms are spaced apart according to the required width between the walls of the finished module, which is then completed as necessary, for example, by adding separately precast end walls and dividers and precast roof, before interior finishing.

Figure 1:
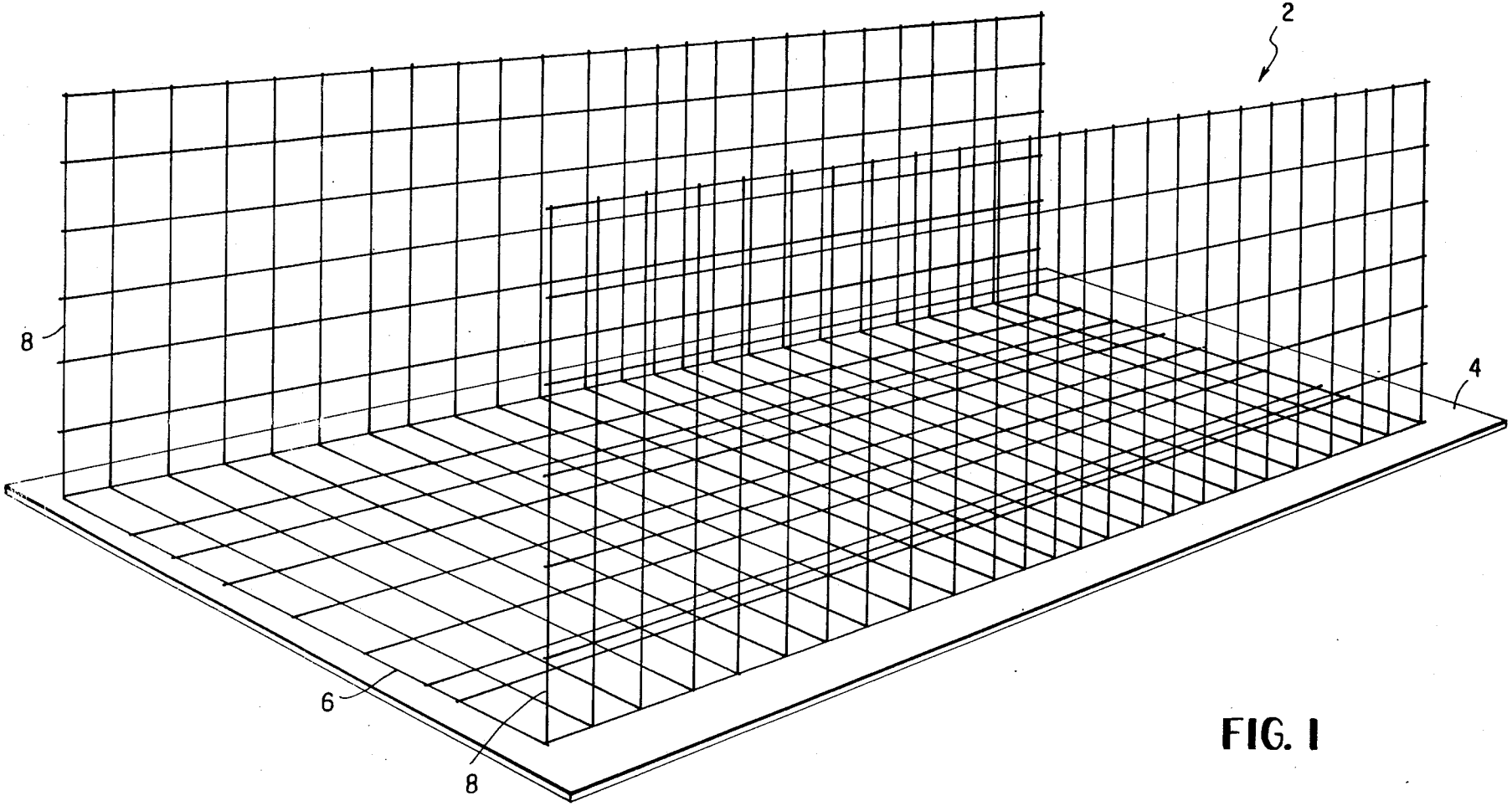
FIG. 1 is a perspective view of a reinforcing steel framework placed on a casting bed.

With reference to FIGS. 1 through 8, in which like numerals represent like parts, representing a preferred embodiment of the invention, FIG. 1 shows a U-shaped steel reinforcing mesh 2 placed on casting bed 4 ready for application of the concrete floor and walls. U-shaped mesh 2 comprises a floor section 6 and two wall sections 8 adjacent and perpendicular to floor section 6.

Figure 2:
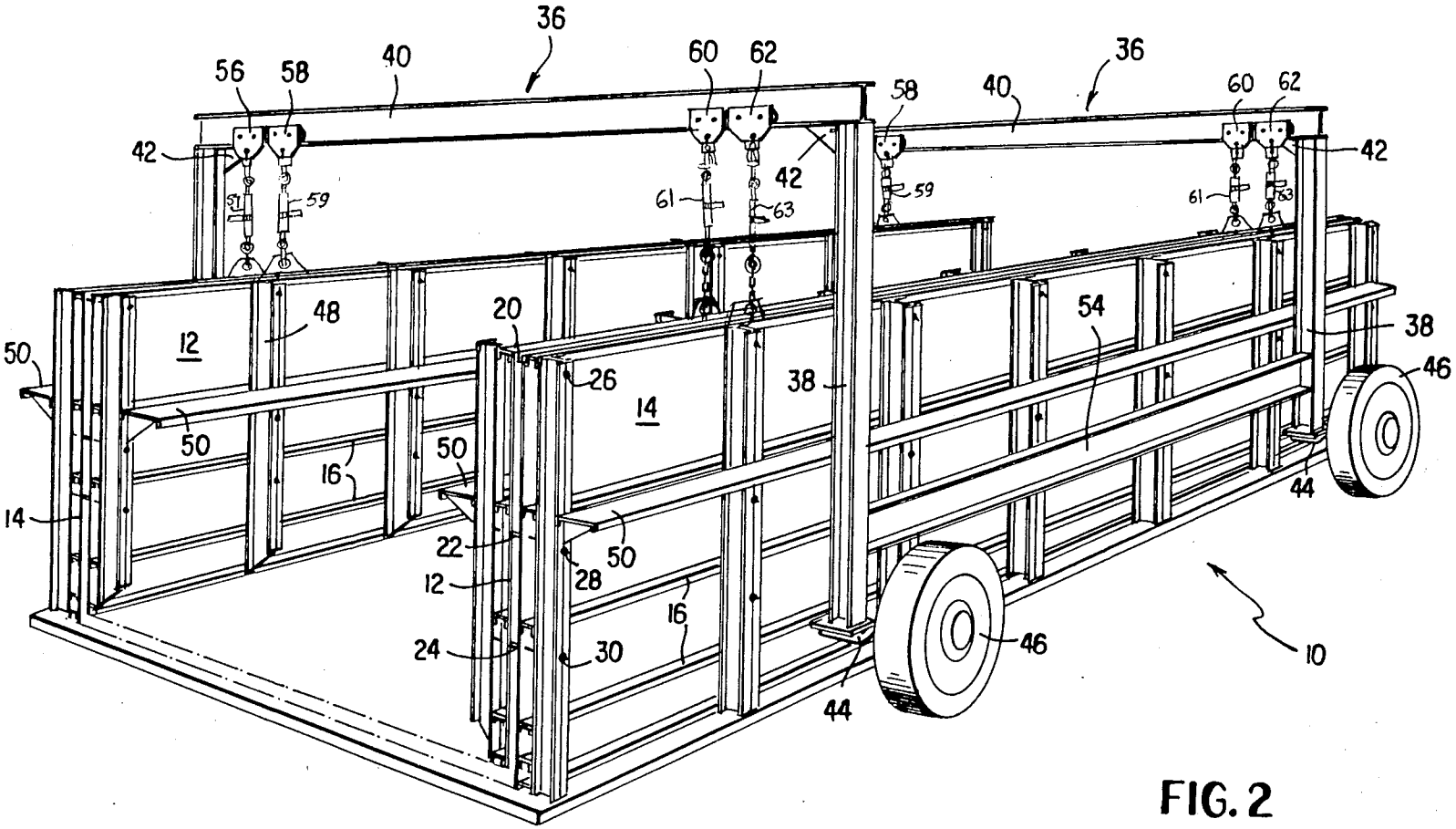
FIG. 2 is a perspective view of a traveling mold of the invention.
Figure 4:
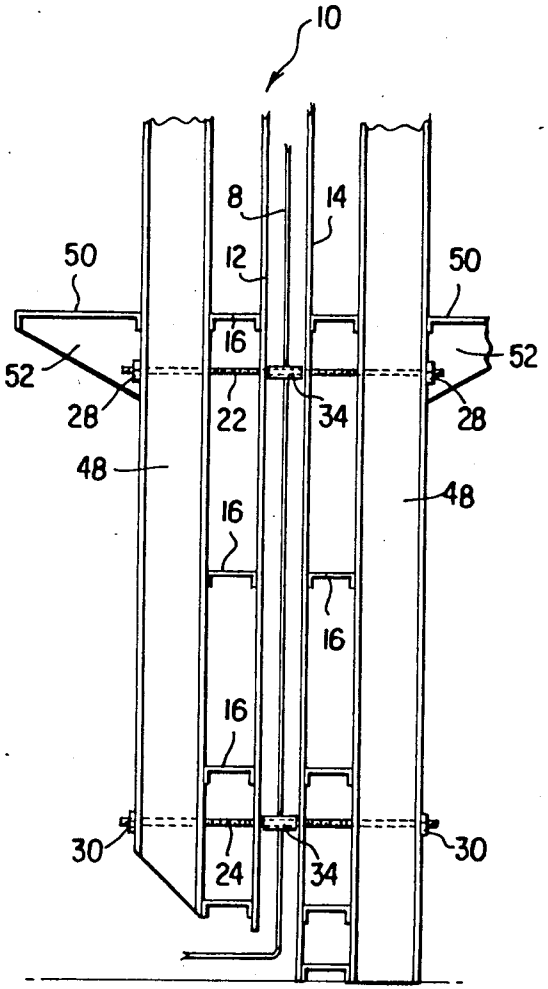
FIG. 4 is a detail of an end view of the mold with a reinforcing steel cage in place, prepared for casting.
Figure 3:
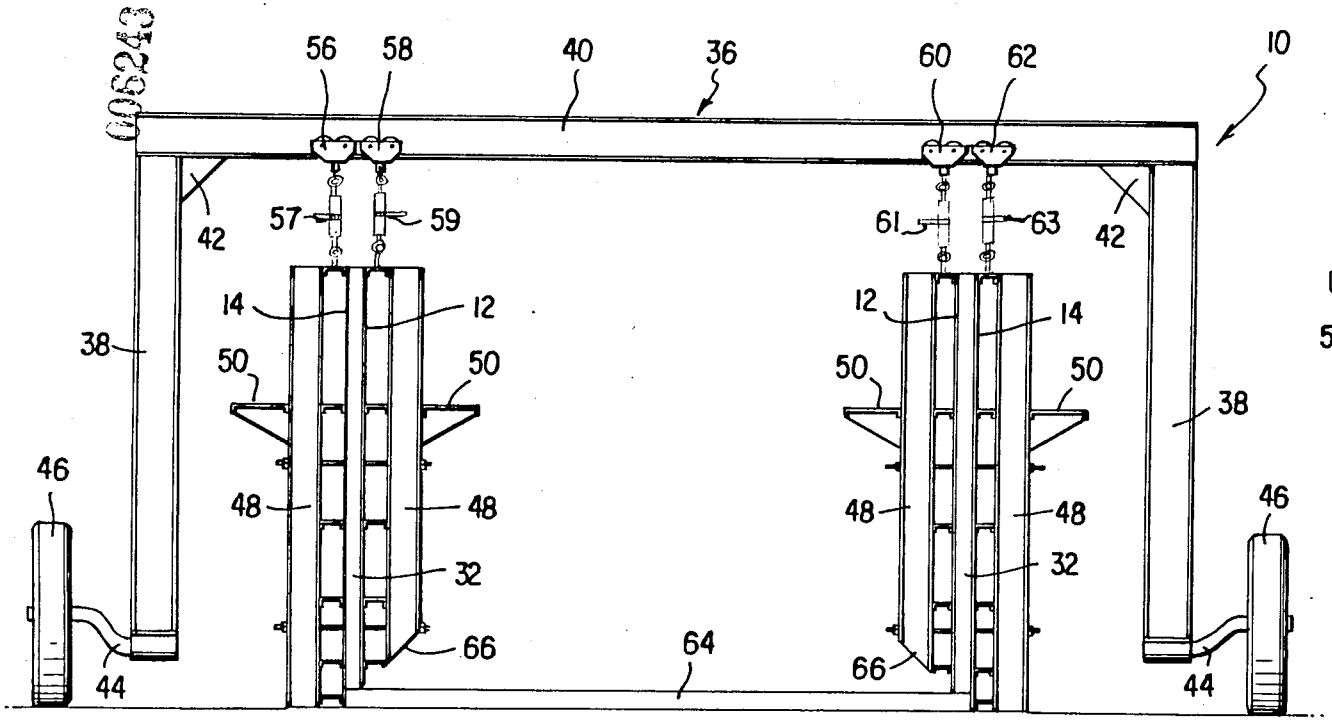
FIG. 3 is an end view of the traveling mold shown in FIG. 2.

The traveling mold 10, shown in FIGS. 2 to 4, is constructed by forming at least two large inverted U-shaped frames 36 of heavy gauge steel I-beams welded together to form a U-shape. The two inverted U-shaped frames are assembled by bolting a vertical member 38 to each end of horizontal member 40 and strengthening the corners with triangular reinforcing corner plates 42. The lower end of each vertical member 38 is attached to wheel support 44 supported by heavy-duty truck-tire 46. The two inverted U-shaped frames are connected together on each side by horizontally placed I-beams 54.

Horizontal supports 16 are welded to I-beams 48 on either side of the walls. Horizontal plates 50 are secured to the opposite side of I-beams 48 from inner wall form 12 or outer wall form 14 and each horizontal plate 50 is held in position by a triangular support 52. When the traveling mold is moved, horizontal plates 50 prevent the outer wall forms 14 from striking vertical members 38.

The top of each inner wall assembly and each outer wall assembly is attached to a trolley assembly running on the upper crossbar 40 of each inverted U-shaped arrangement 36. Each upper crossbar 40 supports four trolley assemblies, one attached to each of the inner and outer wall forms 12 and 14. FIG. 3 shows four trolley assemblies, 56, 58, 60, and 62, running on upper crossbar 40 of U-shaped assembly 36, and attached to the inner and outer wall form assemblies by hoist units, 57, 59, 61, and 63, respectively. Trolley assemblies 56 and 62 are attached to the outer wall forms 14 and trolley assemblies 58 and 60 are attached to the inner wall forms 12.

The trolley assemblies, known in the art, are heavy-duty cast-iron trolleys (such as the SHAW-BOX model "E" plain roller bearing trolley, manufactured by Dresser Industries, Inc., Muskegon, Mich. which enable the wall sections to be individually moved. Each trolley assembly comprises a raising unit, or hoist, preferably including a ratchet binder (such as the L-140 ratchet binder, manufactured by Crosby Group, Inc.) for vertically moving each wall form, in addition to a pulley unit, operated by pulley chains (not shown) for moving each wall form transversly on the upper crossbar. Each wall form 12 and 14 may be moved independently of each other wall form by means of the appropriately connected trolley assemblies.

FIG. 2 shows traveling mold 10 which is wheeled onto casting bed 4, reinforcing mesh panels 8 sliding between inner wall forms 12 and outer wall forms 14 of the traveling mold. Inner wall forms 12 and outer wall forms 14 are made of sheet steel reinforced with horizontal members 16 and vertical members 18, which are preferably I-beams. Each inner wall form is connected to the corresponding outer wall form by taper ties secured with nuts, maintaining wall forms 12 and 14 spaced apart the thickness of the concrete wall being formed. After the traveling mold 10 has been rolled into place to enclose reinforcing mesh 8, taper ties 20, 22, and 24, secured by nuts 26, 28, and 30, respectively, are spaced at suitable vertical intervals in each end of traveling mold 10 to maintain inner wall form 12 and outer wall form 14 in correct spaced alignment. Further ties are used, as necessary. Each tie is preferable inserted through a PVC pipe which spans the space between inner wall form 12 and outer wall form 14 so that the tie may readily be removed even though the plastic pipe may become embedded in the concrete. When the ties are secured in position, each end of the mold is closed, appropriately by a wooden member, to form the end of the wall. Wooden member 32 is shown in FIG. 3. The steel plates forming inner wall forms 12 and outer wall forms 14 are preferably each ¼ in. in thickness. Alternative embodiments will be well known to those skilled in the art.

FIG. 4 shows a detail of an end of a wall combination of traveling mold 10 prior to closing it with wooden member 32. Inner wall forms 12 and 14 are shown (adjacent each side of reinforcing mesh 8) reinforced at intervals by horizontal supports 16, inner wall forms 12 and 14 being connected together with tie rod 22 secured by nut 28. PVC pipe 34, forming a collar for tie rod 22, may be chiseled out of the end of the concrete wall, after forming, and the resultant cavity filled to present a smooth end to the wall.

In use, the traveling mold 10 is wheeled into position enclosing the vertical panels of U-shaped mesh 8 between the inner wall forms 12 and outer wall forms 14. Outer wall forms 14 are movable vertically and transversely by means of trolley assemblies 56 and 62 and inner wall forms 12 are movable vertically and transversely by trolley assemblies 58 and 60 on I-beam 40, the walls being moved into position surrounding reinforcing mesh 8. Tie rods 20, 22, and 24, held by nuts 26, 28 and 30, are inserted to hold the wall forms in position adjacent mesh 8. As many tie rods as are needed are used, for example, sixteen rods or more may be used in each wall.

When the wall forms 12 and 14 are secured in position, concrete is first poured to form floor 64, reinforced by mesh 6. Each inner wall form 12 has a beveled surface 66 at its lower edge enabling the concrete floor to be poured to extend under inner wall form 12 up to the inner edge of outer wall form 14. After the concrete floor has been poured, concrete is poured into the cavity between each inner wall form 12 and outer wall form 14 (surrounding reinforcing mesh 8). The freshly poured concrete is vibrated with a pencil-type electric vibrator having a metal tip which is inserted into the cavity between the concrete wall forms and vibrated to settle the concrete firmly, avoiding the formation of air pockets (which would weaken the wall). Suitable vibrators are manufactured by the Wacker Corporation, of Milwaukee, Wis. Shapes for doors and windows in the walls of the module may be prepared before closing the mold, and concrete may be placed satisfactorily below window spaces using an electric vibrator. When the concrete has been poured, the mold is left in place until the walls are sufficently cured to be self-supporting.

The mold may be removed relatively soon after pouring the concrete because no additional load is placed on the walls (such as, by a roof). The mold may be removed when the walls are able to be self-supporting, without being propped, which may take as little time as 20 hours, depending on conditions. The floor and wall structure is left to cure for 4 to 7 days before the roof is added.

Before pouring any concrete, conduits for electric wires, pipes for water, and/or conduits for gas may be placed abutting the wire mesh, to be embedded in concrete when the floor and walls are poured. After the wall forms have been removed, the walls are troweled to smooth rough spots, as necessary.

When the reinforced concrete floor and walls have hardened for about 20 hours and the forms are to be moved, the taper ties are loosened by removing the threaded nuts. The PVC pipe remains in the end of the wall, embedded in the concrete, and can be removed after two days. The holes left by the PVC pipe are trowelled with mortar. Alternatively, the PVC pipe may remain embedded in the wall.

As a preliminary step, before pouring the concrete, the casting bed and wall-adjacent surfaces of the inner and outer wall assemblies are treated with an adhesion inhibiting compound (commonly a silicone fluid) enabling the inner and outer wall assemblies subsequently to be easily separated from the hardened concrete wall after the connecting ties have been removed. Typically, the wall forms are separated two inches transversely away from the concrete walls and are raised two inches from the floor. The wheeled assembly 10 is then slowly rolled away. Sufficient personnel are used to guide the wall forms so that the wall forms do not swing unduly. Problems of swinging are not encountered unless the wind is unusually high.

To further describe the trolley assemblies, hoist units 57, 59, 61 and 63 attaching each inner and outer wall form to trolleys 56, 58, 60 and 62 preferably each includes, as part of the hoist unit which moves the wall form vertically, a screw-operated turnbuckle or ratchet binder, typically having a handle operated ratchet and pawl mechanism for turning the turnbuckle, for the purpose of raising and dropping each wall form. Pulley chains (not shown), passing around the pulley unit on each trolley, may be operated directly to move the wall forms, or the pulley chains may operate a gear mechanism incorporated in each pulley assembly of the trolley to facilitate such movement. Suitable trolley assemblies, typically hand geared trolleys, for moving the wall forms, are known to one skilled in the art.

With reference to FIG. 6, inner wall modules 70, pre-cast at a separate location, are moved into the open box-like module, already cast, and secured into place by welding, or other appropriate means. These wall panels form separate room partitions in the modules. When the walls have hardened to withstand pressure of 2,000 pounds per square inch (in about 4 to 7 days) the roof may be assembled onto the open box-like module. Typically, ¾ inch coil rods 68 are inserted in pairs at the top of the mold for each side wall, before the concrete is poured , so that the finished walls each have two pairs of rods 68 upstanding therefrom, as shown in FIG. 5, for securing the roof to the walls.

FIG. 7 shows a pre-cast, reinforced concrete roof panel 72 which has been cast at a remote site, and which has apertures 74 through edge 76 thereof for engaging rods 68. Roof panel 72 is engaged on the module, as shown in FIG. 8, and lifting plates 78 are added to enable the finished module to be removed from the casting bed, by crane, to another site for interior finishing. The module is easily lifted from the casting bed (treated with adhesion-inhibiting compound before casting the floor). Modules may be assembled side-by-side to form a multi-room dwelling, if required.

While the traveling mold of the invention has been described in detail for use in forming rectangular prefabricated housing units, other applications for different shapes of units are equally within the scope of the invention. The walls formed need not be parallel, but may stand at an angle to each other, being more narrowly spaced at one end than at the other. A single wall may be formed at one side of a floor or in the middle of a floor, although additional care is needed to form a wall upstanding from the middle of a floor since the bottom edges of both sides of the wall forms must be beveled. In an alternative embodiment, the wall may be curved, for example, upstanding from a similarly curved edge of a floor. In such a case the inner and outer wall forms need to be separated sufficiently far from the wall to enable the traveling mold to be moved to the next casting bed.

The preferred embodiment of the traveling mold is movable on wheels. Ski-like skids, or other means of supporting the mold, while enabling it to be moved may also be used. Trolley assemblies, as described, are the preferred means of raising the wall forms vertically and moving them transversely, but other means of moving the wall forms using manual or motorized equipment may be used.

While the invention has been described above with respect to certain embodiments thereof, it will be appreciated that various changes and modifications may be made without departing from the spirit and scope of the invention.

What is claimed is:

1. A traveling casting mold for forming a pre-cast reinforced concrete structure comprising:

inverted U-shaped movable frame means for supporting the mold, said frame means comprising vertical outer members joined by a cross bar member and wheel means attached to each said vertical outer member leaving the area under the cross bar substantially free from the wheel means, moving means traveling between said outer vertical members on the crossbar of the movable frame means for movably attaching wall form means to said crossbar, and inner wall form means and outer wall form means each attached to said moving means, for directly supporting poured concrete walls of the structure, wherein each said inner wall form means and outer wall form means is individually movable vertically and transversely by said moving means, and wherein a concrete floor portion and at least one concrete wall are formed in a single concrete pouring and the at least one concrete wall is sufficiently cured to be self supporting before moving said inner wall form means and outer wall form means away from direct support of the said at least one concrete wall.

2. A traveling mold of claim 1 wherein said movable frame means comprises a plurality of inverted U-shaped frames.

3. A traveling mold of claim 2 wherein each frame comprises members welded to form a U-shaped frame.

4. A traveling mold of claim 1 wherein the moving means comprises a plurality of raising assemblies traveling on each movable frame means, each raising assembly supporting an inner wall form means or an outer wall form means.

5. A traveling mold of claim 1 wherein the moving means comprises pulley means.

6. A traveling mold of claim 1 wherein a lower edge of each said inner wall form means is beveled toward a center portion of the structure enabling a floor section to be laid adjoining and perpendicular to an upstanding wall section.

7. A traveling mold of claim 1 wherein said inner wall form means and said outer wall form means each comprises impervious sheet means for facing a wall.

8. A traveling mold of claim 7 wherein the impervious sheet means comprises steel sheet.

9. A traveling mold of claim 1 wherein said inner wall form means and said outer wall form means are each substantially the same height and length as the height and length of a wall formed between them.

10. A traveling mold of claim 1 wherein the movable frame means further comprises wheels attached to each frame means.

11. A traveling mold of claim 1 wherein said moving means comprises trolley means for traveling on the wheeled frame means, between said outer members, and a plurality of inner wall means and outer wall means each attached to said trolley means, for supporting poured concrete walls of the pre-cast module, wherein a concrete floor and walls are poured in a single pouring and each of said wall means is individually movable away from formed walls of the module to provide an at least partially cured floor and wall combination.

* * * * *